US009469123B2

(12) United States Patent
Tsuboi et al.

(10) Patent No.: US 9,469,123 B2
(45) Date of Patent: Oct. 18, 2016

(54) INKJET PRINTING APPARATUS AND INKJET PRINTING METHOD

(75) Inventors: Hitoshi Tsuboi, Kawasaki (JP); Yoshitomo Marumoto, Kawasaki (JP); Ryota Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 552 days.

(21) Appl. No.: 13/429,976

(22) Filed: Mar. 26, 2012

(65) Prior Publication Data

US 2012/0249646 A1 Oct. 4, 2012

(30) Foreign Application Priority Data

Mar. 29, 2011 (JP) ..... 2011-072218

(51) Int. Cl.
*B41J 2/21* (2006.01)

(52) U.S. Cl.
CPC ..... *B41J 2/2107* (2013.01)

(58) Field of Classification Search
CPC ..... B41J 2/2107
USPC ..... 347/15
See application file for complete search history.

(56) References Cited

U.S. PATENT DOCUMENTS 6,341,833 B1 1/2002 Liu et al.
6,412,938 B1 * 7/2002 Markham et al. ..... 347/100
7,113,729 B2 9/2006 Toyohara
7,121,641 B2 10/2006 Nitta et al.
7,421,231 B2 9/2008 Bessho
7,517,052 B2 4/2009 Wada et al.
7,522,852 B2 4/2009 Toyohara
7,585,039 B2 9/2009 Ochiai et al.
7,614,713 B2 11/2009 Marumoto
7,726,763 B2 6/2010 Ochiai et al.
7,901,025 B2 3/2011 Kato et al.
8,018,621 B2 9/2011 Marumoto et al.
8,184,339 B2 5/2012 Marumoto et al.
8,208,176 B2 6/2012 Takahashi et al.
8,366,226 B2 2/2013 Kato et al.

(Continued)

FOREIGN PATENT DOCUMENTS

CN 1640670 A 7/2005
CN 1828451 A 9/2006

(Continued)

OTHER PUBLICATIONS

Office Action in Chinese Patent Application No. 201210089621.2, dated Apr. 22, 2014.

(Continued)

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

An inkjet printing apparatus and an inkjet printing method capable of suppressing generation of bronze phenomenon regardless of the color gamut are provided. For this purpose, in multipass printing, more pixels permitted to print by at least one type of achromatic color ink than pixels permitted to print by chromatic color ink in the last print scan to a unit region are set. Accordingly, it becomes possible to apply achromatic color ink having a high bronze phenomenon reduction effect on the topmost layer of the print medium, and thereby generation of bronze phenomenon can be suppressed without any hue shift.

10 Claims, 18 Drawing Sheets

(56) References Cited

U.S. PATENT DOCUMENTS

| | | | | |
|---|---|---|---|---|
| 8,477,361 | B2 | 7/2013 | Marumoto | |
| 2002/0063750 | A1* | 5/2002 | Kanda et al. | 347/41 |
| 2005/0007416 | A1* | 1/2005 | Takekoshi et al. | 347/41 |
| 2005/0018222 | A1 | 1/2005 | Yoshida | |
| 2008/0024575 | A1* | 1/2008 | Yue et al. | 347/100 |
| 2008/0137146 | A1 | 6/2008 | Marumoto | |
| 2009/0015611 | A1 | 1/2009 | Ochiai et al. | |
| 2009/0310150 | A1 | 12/2009 | Marumoto | |
| 2011/0019208 | A1 | 1/2011 | Yamaguchi et al. | |
| 2013/0113856 | A1 | 5/2013 | Kato et al. | |

FOREIGN PATENT DOCUMENTS

| | | | |
|---|---|---|---|
| CN | 101362395 | A | 2/2009 |
| CN | 101432141 | A | 5/2009 |
| CN | 101920601 | A | 12/2010 |
| JP | 04-364961 | A | 12/1992 |
| JP | 2001-138555 | A | 5/2001 |
| JP | 2002-292908 | A | 10/2002 |
| JP | 2002-307671 | A | 10/2002 |
| JP | 2004-358690 | A | 12/2004 |
| JP | 2005-049521 | A | 2/2005 |
| JP | 2006-334968 | A | 12/2006 |
| JP | 2008-093965 | A | 4/2008 |
| JP | 2008-162094 | A | 7/2008 |
| JP | 2009-083499 | A | 4/2009 |
| JP | 4261980 | B2 | 5/2009 |

OTHER PUBLICATIONS

Office Action in Japanese Patent Application No. 2011-072218, dated Jan. 27, 2015.

* cited by examiner

INKJET PRINTING APPARATUS AND INKJET PRINTING METHOD

BACKGROUND OF THE INVENTION

1. Field of the Invention

The present invention relates to an inkjet printing apparatus which uses ink for printing. Particularly, it relates to a printing method of suppressing bronze phenomenon of an image in a serial inkjet printing apparatus which uses a plurality of colors of ink.

2. Description of the Related Art

In an inkjet printing apparatus which uses pigment ink or ink of low permeability into the print medium, the ink, by nature, tends to remain on the surface of the print medium and therefore a layer is formed on the print medium in the order of the printed ink. Accordingly, properties such as glossiness or bronze phenomenon which depend on surface roughness or surface material characteristics of the printed matter are affected by the characteristics of the ink last printed on the print medium. As a result, in a serial inkjet printing apparatus configured to perform multipass printing, the degree of glossiness and bronze phenomenon in an image varies depending on the printing direction in bidirectional printing, or the mask pattern to be used or print data.

Considering the above situation, Japanese Patent Publication No. 4261980, for example, discloses a printing method of controlling the amount of ink printed in a print scan that determines the dominant color (forms the topmost surface) of a serial type inkjet printing apparatus which performs multipass printing. Specifically, focusing attention on the fact that printing of cyan ink, in particular, easily affects glossiness and bronze phenomenon, a printing method is disclosed which sets the printing rate of ink other than cyan higher than the printing rate of cyan in the print scan that determines the dominant color (forms the topmost surface). Performing such a printing method allows an ink which is unlikely to affect glossiness and bronze phenomenon to be printed on the topmost surface of the image, whereby it becomes possible to suppress uneven glossiness and generation of bronze phenomenon.

In the configuration of the Japanese Patent Publication No. 4261980, however, the effect can be obtained only in a color gamut where ink which is unlikely to affect glossiness and bronze phenomenon (e.g., yellow ink) is printed simultaneously together with ink which is likely to affect glossiness and bronze phenomenon (e.g., cyan ink). Specifically, there has been a problem that it is difficult to obtain the effect in a color gamut where the printing rate of other ink is extremely low compared with cyan ink.

SUMMARY OF THE INVENTION

The present invention has been made in order to solve the above problem, and has an object to provide an inkjet printing apparatus and an inkjet printing method capable of suppressing generation of bronze phenomenon regardless of the color gamut.

In a first aspect of the present invention, there is provided an inkjet printing apparatus which prints an image on a unit region of a print medium by performing, according to image data, print scans of a nozzle array configured to eject chromatic color ink and a nozzle array configured to eject at least one type of achromatic color ink for a plurality of times on each of the unit regions, the apparatus comprising a defining unit for defining pixels permitted to print the image data and pixels not permitted to print for each of the print scans, wherein there are more pixels permitted to print by at least one type of achromatic color ink among the achromatic color inks than pixels permitted to print by the chromatic color ink to the unit region in the last print scan among the plurality of times of print scans.

In a second aspect of the present invention, there is provided an inkjet printing method which prints an image on a unit region of a print medium by performing, according to image data, print scans of a nozzle array configured to eject chromatic color ink and a nozzle array configured to eject at least one type of achromatic color ink for a plurality of times on each of the unit regions, the method comprising a defining step for defining pixels permitted to print the image data and pixels not permitted to print for each of the print scans, wherein there are more pixels permitted to print by at least one type of achromatic color ink among the achromatic color inks than pixels permitted to print by the chromatic color ink to the unit region in the last print scan among the plurality of times of print scans.

Further features of the present invention will become apparent from the following description of exemplary embodiments (with reference to the attached drawings).

DESCRIPTION OF THE EMBODIMENTS

In the following, an embodiment to be the basis of a characteristic configuration of the present invention will be described.

First Embodiment

Figure 13:
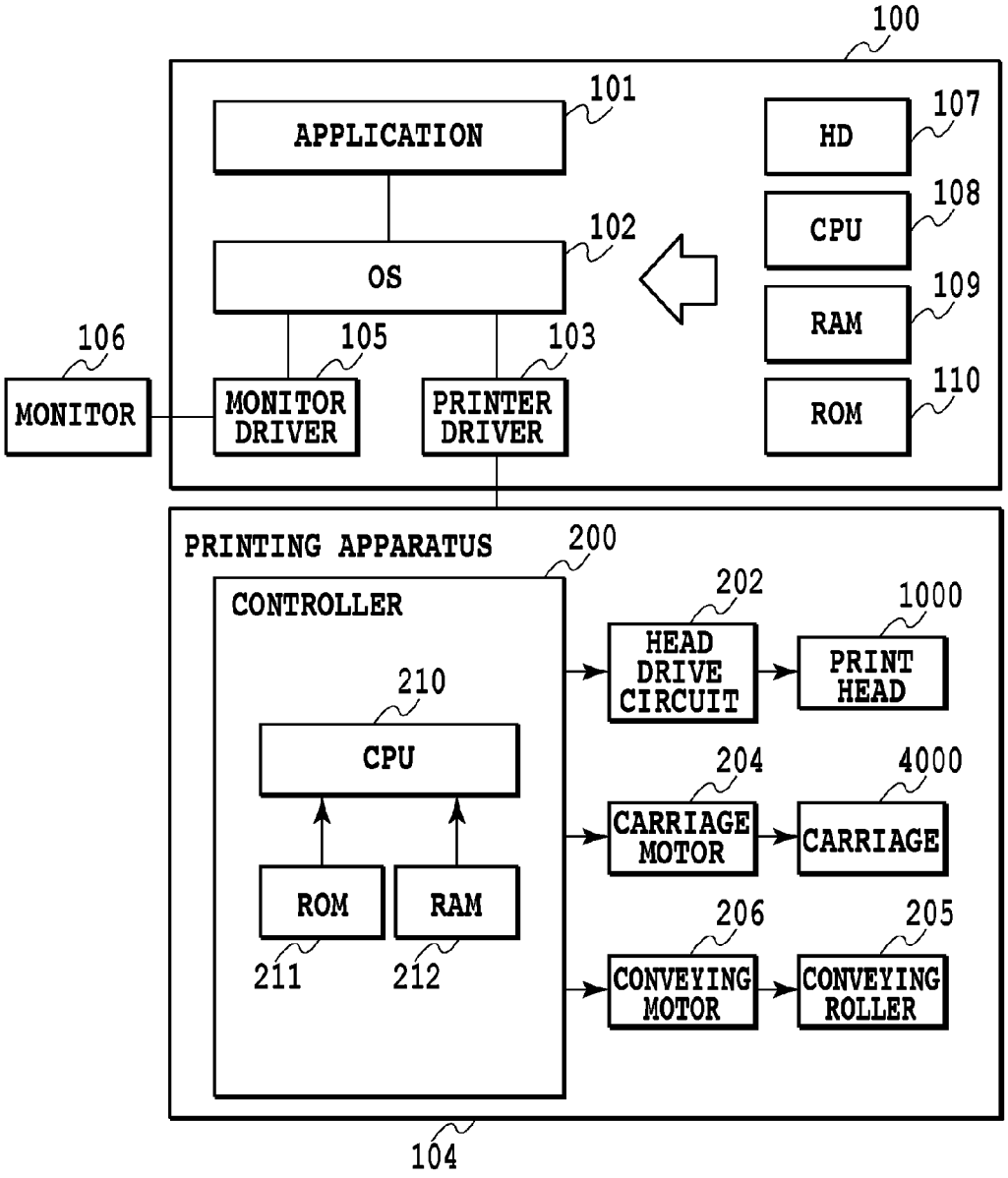
FIG. 13 is a block diagram illustrating a printing system applicable to the present invention.

FIG. 13 is a block diagram illustrating the configuration of a host device 100 and a printing apparatus 104 included in the printing system of an inkjet printing apparatus applicable to the present invention.

A CPU 108 causes respective software products of an application 101, a printer driver 103, and a monitor driver 105 to operate via an operating system 102 in accordance with various programs stored in a hard disk (HD) 107 and a ROM 110. In this occasion, a RAM 109 is used as a work area when performing various processes. The monitor driver 105 is a software product which performs processes such as generating image data to be displayed on a monitor 106. The printer driver 103 is a software product which converts image data transferred from application software 101 to the OS 102 into multi-valued or binary image data receivable by the printing apparatus 104 and subsequently transmits it to the printing apparatus 104.

The inkjet printing apparatus 104 is provided with a controller 200, a print head 1000, a head drive circuit 202, a carriage 4000, a carriage motor 204, a conveying roller 205, a conveying motor 206 or the like. The head drive circuit 202 is a circuit configured to drive the print head 1000, and drives the print head 1000 to eject ink. The carriage motor 204 is a motor configured to reciprocate the carriage 4000 that carries the print head 100. The conveying motor 206 is a motor configured to rotate the conveying roller 205 that conveys print medium. The controller 200 configured to control the entire apparatus is provided with a CPU 210 in a form of a microprocessor, a ROM 211 storing a control program, a RAM 212 used when the CPU performs image data processing, or the like. The ROM 211 stores mask patterns described below and a control program for controlling multipass printing of the present invention or the like. In order to perform multipass printing, for example, the controller 200 controls the head drive circuit 202, the carriage motor 204 and the conveying motor 206, and also generates image data corresponding to each scan of multipass printing. Specifically, the controller 200 reads out a mask pattern from the ROM 211 according to the control program and uses the read-out mask pattern to divide the image data corresponding to a unit region into image data to be printed by a nozzle block corresponding to each scan of multipass printing. Furthermore, the controller 200 controls the head drive circuit 202 so that ink is ejected from the print head 1000 according to the divided image data.

Figure 14:
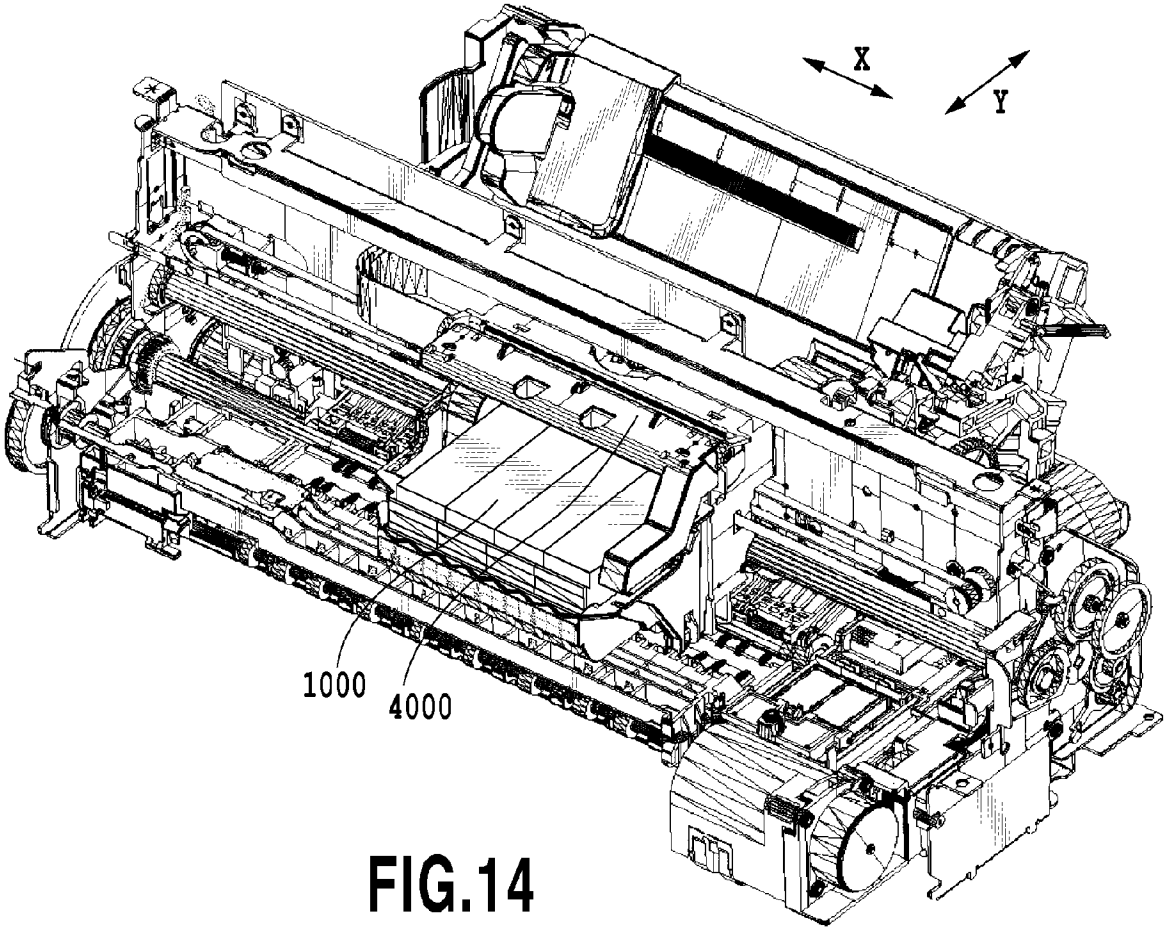
FIG. 14 is an explanatory perspective view of the overall configuration of a printing apparatus employed in the present embodiment.

FIG. 14 is an explanatory perspective view of the overall configuration of the inkjet printing apparatus 104 employed in the present embodiment. The carriage 4000 as a moving device has mounted thereon the print head 1000 having four nozzle groups which respectively eject cyan (C), magenta (M), yellow (Y) and black (K) ink, and is configured to be movable in an X direction (second direction) in the drawing. A control device (not shown) including the controller or the like causes the print head 1000 to eject ink while the carriage 4000 is moving in the X direction, according to the image data received from a host apparatus. When a single print scan by the print head 1000 is finished, a conveying device (not shown) including the conveying roller or the like conveys the print medium in a Y direction crossing the X direction by an amount according to the number of passes in the multipass printing. Subsequently, an image is formed in a stepwise manner on the print medium by repeating the printing associated with the head movement in the X direction (head movement direction) and the conveyance in the Y direction.

Figure 15:
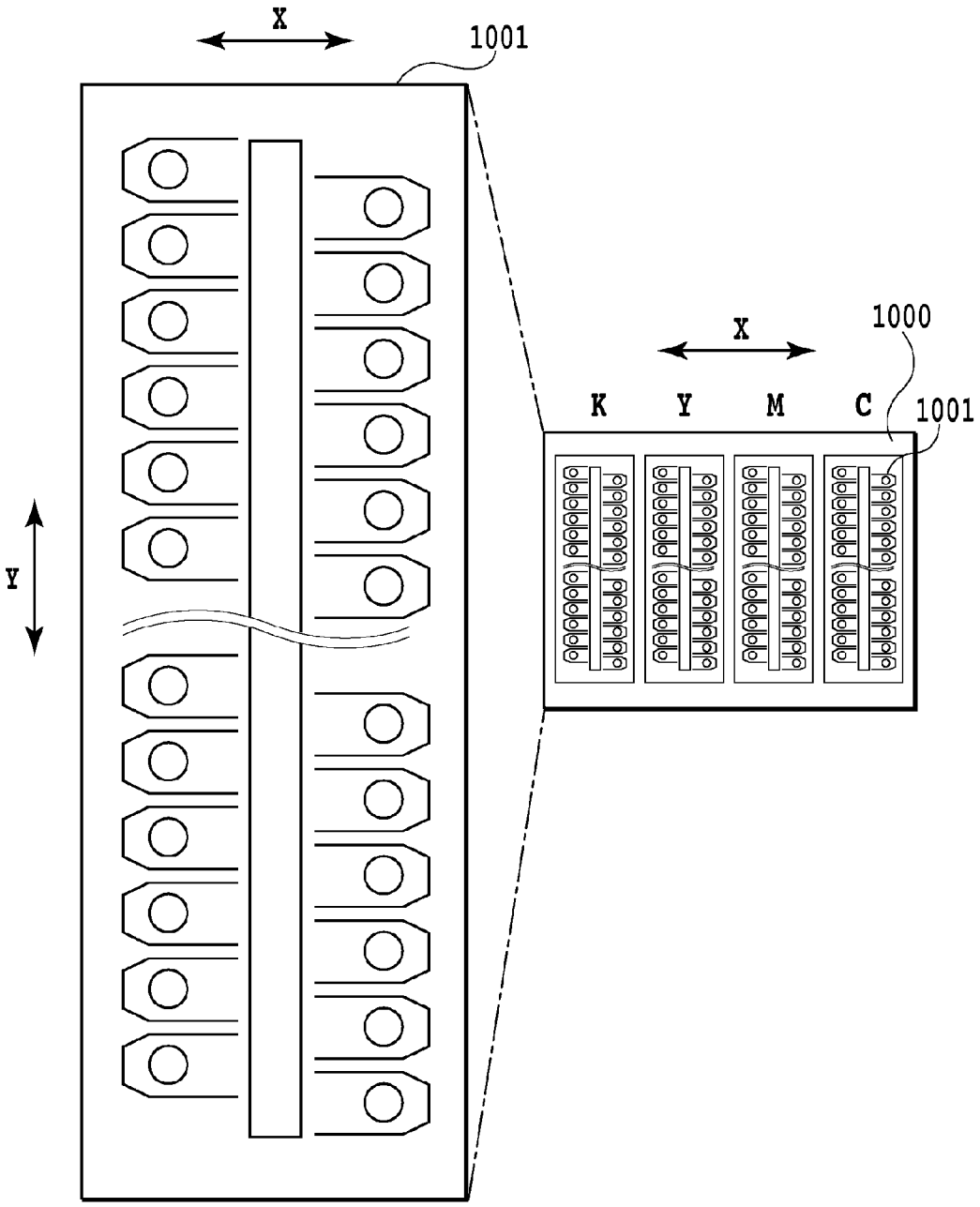
FIG. 15 is an explanatory schematic view of the configuration of the print head employed in the first embodiment.

FIG. 15 is an explanatory schematic view of a nozzle arrangement state of the print head 1000 employed in the present embodiment. The print head 1000 of the present embodiment has four nozzle arrays 1001 which respectively eject four, i.e., the first to the fourth, types of ink, arranged in parallel in the X direction (movement direction of the head). In the present embodiment, the first ink is cyan ink (C), the second ink is magenta ink (M), the third ink is yellow ink (Y), and the fourth ink is black ink (K). Each nozzle array 1001 of each color has 256 nozzles arranged in the first direction. Specifically, each nozzle array 1001 of each color has two arrays in which 128 nozzles are arranged in the first direction (here, Y direction) with a pitch of 600 dpi, the two arrays being arranged in the first direction in a manner displaced from each other by a half pitch. In other words, the print head 1000 ejects ink from individual nozzles while moving in the X direction, whereby an image having a resolution of 1200 dpi (dot/inch) in the Y direction can be printed.

As thus described, the present embodiment employs a print head having a plurality of nozzle arrays associated with ink colors, each array including a plurality of nozzles configured to eject the same color ink.

The present embodiment has been described in a manner such that, for simplicity, the direction of arrangement of a plurality of nozzles configured to eject the same color ink (first direction) coincides with the direction of conveyance of the print medium (Y direction) for each color. In the present invention, however, the direction of arrangement of the nozzles (first direction) need not necessarily coincide with the direction of conveyance (Y direction) for each color. Even if the direction of arrangement of the nozzles (first direction) is skewed to the Y direction to a certain degree, the advantage offered by the present invention described below can be obtained invariably.

Figure 18:
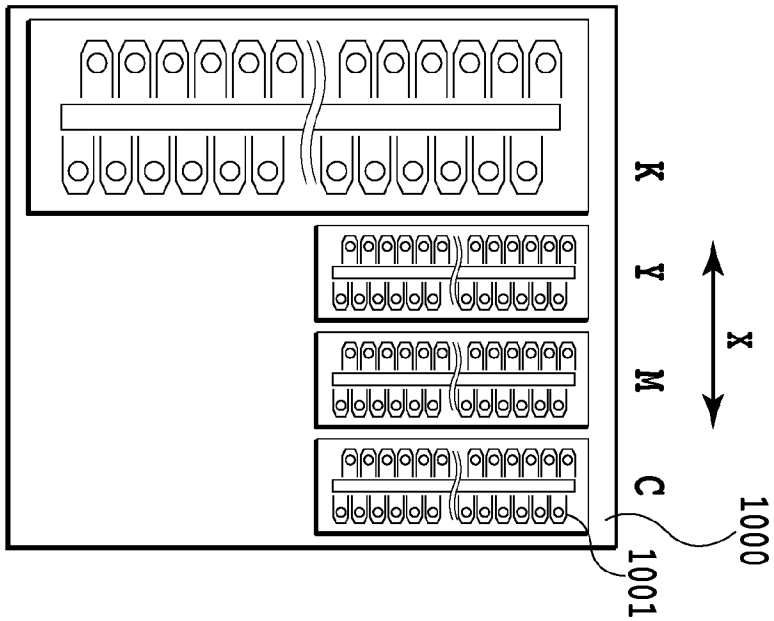
FIG. 18 illustrates another exemplary print head applicable in to the present invention.

Additionally, in FIG. 15, although a configuration has been illustrated in which all types of ink are ejected from nozzle arrays having the same arrangement density, some colors may have a different nozzle arrangement density or ejection volume. In addition, the lengths of the nozzles in the direction of arrangement (first direction) may be different depending on the ink color. For example, FIG. 18 illustrates another exemplary print head applicable in the present invention. In this example, each of the ejection ports for the black ink is larger than that for other color, and the arrangement density is lower than that of other color. Furthermore, the nozzle array of the black ink is longer in the Y-direction than that of other color. A print head of such a configuration is also applicable to the present invention.

Figure 16:
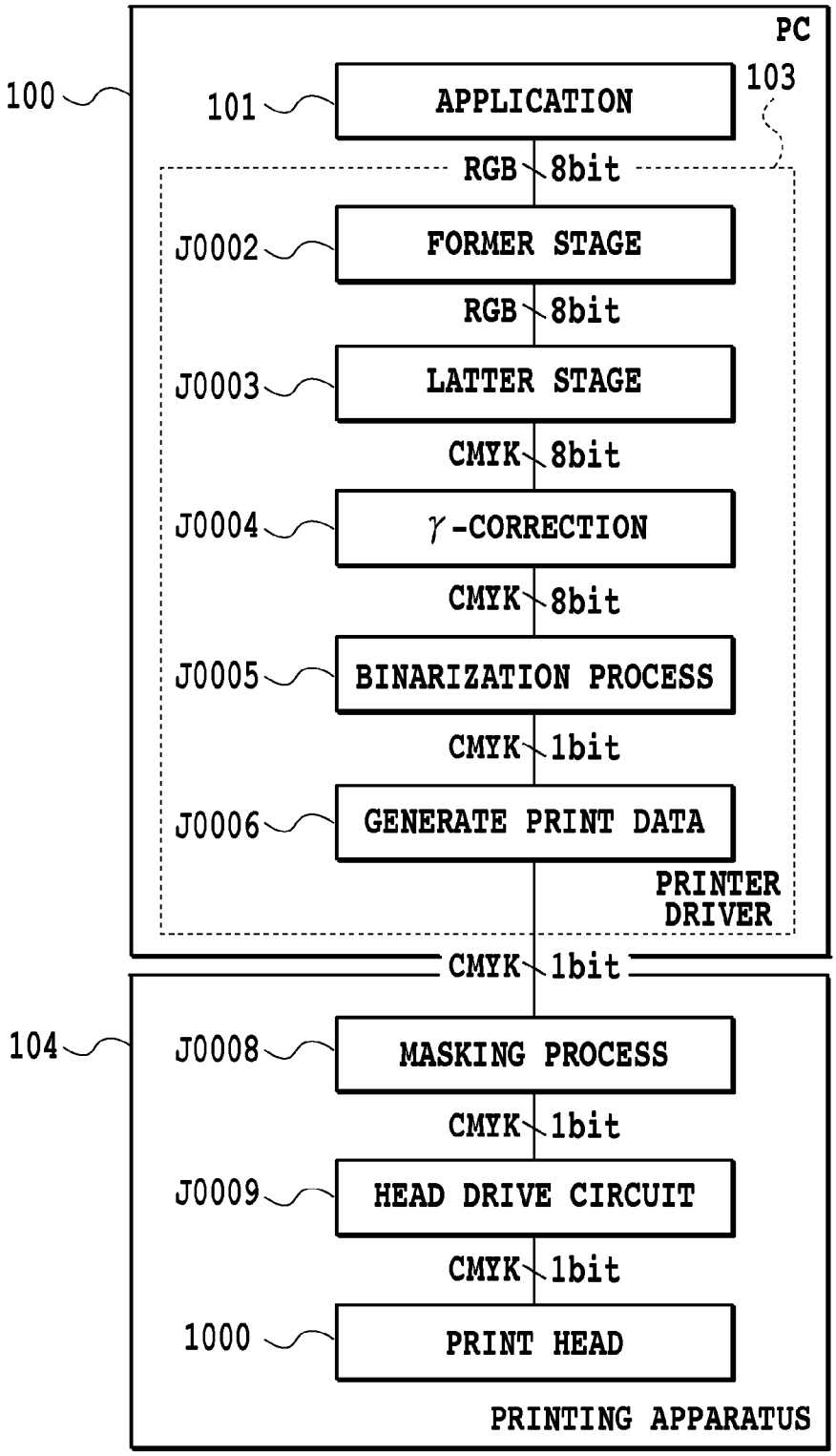
FIG. 16 is an explanatory block diagram of the flow of image processing.

FIG. 16 is an explanatory block diagram of the flow of the image processing performed by the host apparatus 100 and the printing apparatus 104 in the printing system described above.

In the host apparatus 100, the user can use the application 101 to generate image data to be printed by the printing apparatus 104. When performing printing, the image data generated by the application 101 is transferred to the printer driver 103.

The printer driver 103 performs, as its processes, a preprocess J0002, a postprocess J0003, a γ-correction J0004, a binarization process J0005, and a print data generating process J0006, respectively.

In the preprocess J0002, referring to FIG. 14, color gamut conversion is performed to convert the color gamut of an image to be displayed on the monitor 106 by the application 101 via the monitor driver 105 into the color gamut of the printing apparatus 104. Specifically, the image data R, G, and B expressed by 8 bits is converted into 8-bit data R, G, and B in the color gamut of the printing apparatus 104 by referring to a 3-dimensional LUT stored in the ROM 110.

Subsequently, in the postprocess J0003, a signal value conversion is performed so that R, G, and B after conversion are expressed by four ink colors C, M, Y, and K ejected by the print head 1000 mounted on the printing apparatus 104. Specifically, the 8-bit data R, G, and B obtained in the preprocess J0002 is converted into 8-bit data of C, M, Y, and K by referring to the 3-dimensional LUT stored in the ROM 110.

In the subsequent γ-correction J0004, γ-correction is performed on the CMYK data obtained in the postprocess J0003. Specifically, linear transformation is performed so that the 8-bit data CMYK obtained by color separation is linearly associated with the gradation characteristics of the printing apparatus.

The binarization process J0005 uses a predetermined quantization method to convert the 8-bit data C, M, Y, and K which has been subject to γ-correction into 1-bit data C, M, Y, and K. For the image data after binarization, it has been determined as 1-bit information whether or not to print a dot on each of individual pixels corresponding to the printing resolution of the printing apparatus 104.

The print data generating process J0006 generates print data, with print medium information, print quality information, and control information relating to the printing operation such as the paper feed method added to the four-color 1-bit data generated in the binarization process J0005. The print data generated as described above is supplied from the host apparatus 100 to the printing apparatus 104.

The print apparatus 104 uses a preliminarily prepared mask pattern to perform a masking process J0008 on the binary image data included in the input print data. Here, the mask pattern is a pattern determining whether or not to permit printing for each of a plurality of pixels included in a region passed across by individual nozzles in a single movement of the print head.

The masking process J0008 uses a predetermined mask pattern preliminarily stored in a memory of the printing apparatus 104 to divide the binary image data into image data to be printed by each of a plurality of nozzle blocks corresponding to each scan of multipass printing. Specifically, an AND operation is performed between the mask pattern determining whether or not to permit printing for each pixel in the region passed across by individual nozzles in a single scan of the print head and the binary image data input from the host apparatus 100. As a result, binary image data to be actually printed by the print head in one print scan is generated. Subsequently, the generated binary image data is sent to a head drive circuit J0009. Individual nozzles of the print head 1000 then perform the printing operation according to the above-mentioned binary image data with a predetermined timing.

Figure 17:
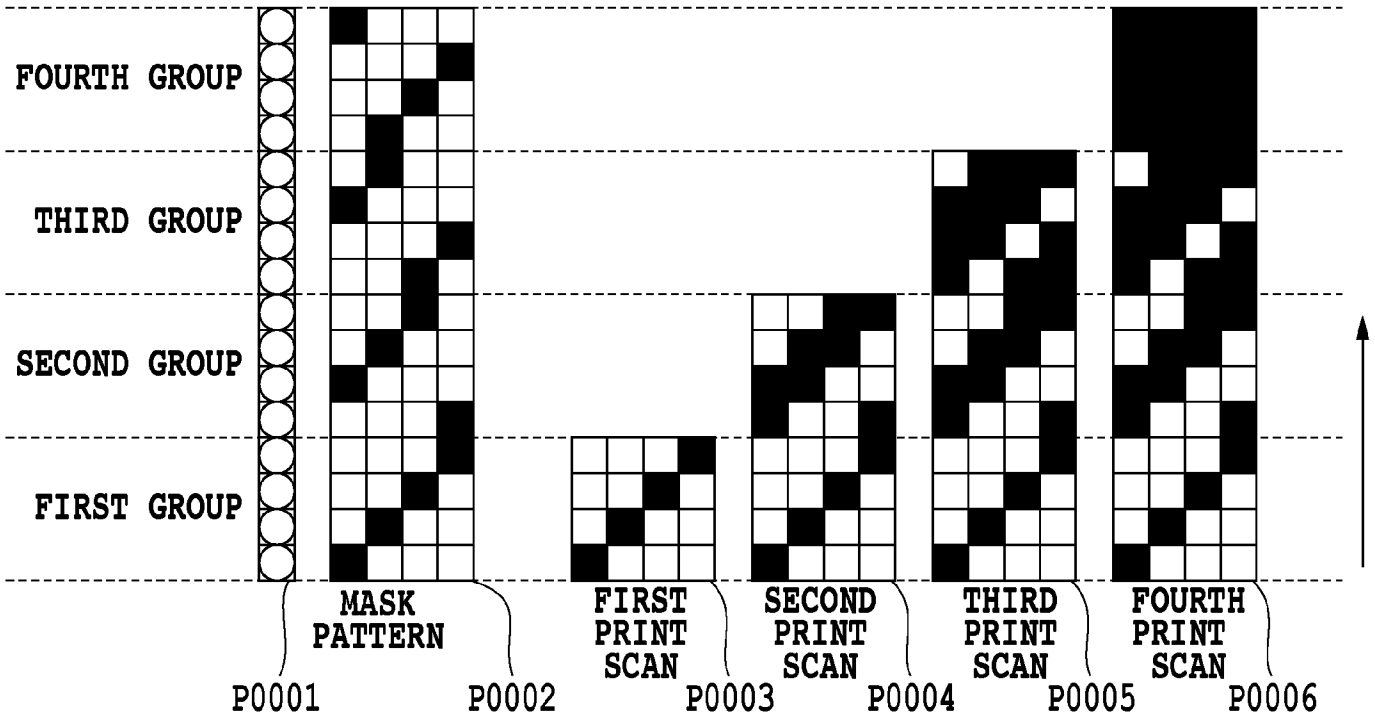
FIG. 17 is an explanatory diagram of multipass printing using a mask pattern.

FIG. 17 is an explanatory diagram of multipass printing using a mask pattern. Here, the print head and a printed dot pattern are schematically shown with four-pass multipass printing taken as an example which completes the image to be printed over a unit region by four scans. In the drawing, P0001 indicates the print head. Here, for simplified explanation, it is expressed as having 16 nozzles. In the case of four-pass multipass printing, a nozzle array is used in a manner divided into four groups, i.e., the first to the fourth, each including four nozzles as shown in the drawing. P0002 indicates a mask pattern in which pixels permitted to perform printing in correspondence with each nozzle (print-permitted pixels) are painted black. Print permission rate is 25% for a mask pattern corresponding to four groups in complementary relation to each other. Therefore, overlaying these four patterns turns all the 4×4 pixels into print-permitted pixels so that printing of the region will be completed by four print scans.

P0003 to P0006 indicate arrangement patterns of dots that are formed and how an image is completed by overlaying print scans. In multipass printing, as indicated by these patterns, dots are printed based on the binary print data (dot data) generated by a mask pattern corresponding to each group in each print scan. Each time a print scan is completed, the print medium is conveyed in the direction of the arrow in the drawing by a width of a group (equivalent to four nozzles). In this manner, an image is printed over a unit region of the print medium by four print scans in the order of the first to the fourth groups.

According to multipass printing as described above, irregularities in direction or volume of ink ejection among a plurality of nozzles occurred during the manufacturing process, or density unevenness due to error of paper conveyance performed between print scans can be made less outstanding.

Although exemplary four-pass multipass printing is shown in FIG. 17, two-pass printing which completes an image by two print scans, three-pass printing which completes an image by three print scans, and furthermore, M-pass multipass printing which completes an image by five or more print scans are also possible. When performing M-pass multipass printing, the N nozzles included in a nozzle array are divided into M groups, and M mask patterns generally having a print permission rate of (100/M) % and being in a complementary relation to each other are prepared. By performing conveying movement by an amount equivalent to N/M nozzles in each print scan, an image is completed in a unit region equivalent to N/M nozzles by M print scans. In the present embodiment, it is assumed that 8-pass multipass printing is performed using the print head described in FIG. 15.

Figure 1:
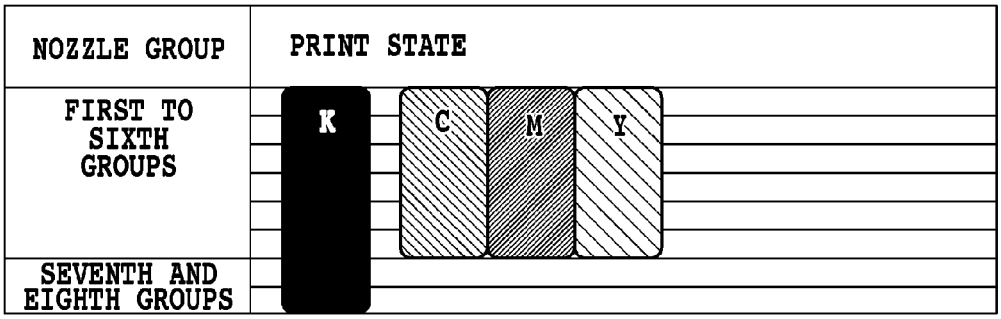
FIG. 1 is an explanatory diagram of a print state in a first embodiment.

FIG. 1 is an explanatory diagram of the print state of each group when performing multipass printing of the present embodiment. When performing 8-pass multipass printing, 256 nozzles are divided into 8 groups, each including 32 nozzles. FIG. 1 illustrates, for each ink color, groups which are actually used for printing out of the 8 groups. In the present embodiment, as can be seen from the drawing, although all of the first to the eighth groups of black ink (K) are used for printing, the seventh and the eighth groups of the cyan ink (C), magenta ink (M), and yellow ink (Y) are not used for printing. As a result, only black ink is printed over a unit region equivalent to the width of 32 nozzles in the seventh print scan and the eighth print scan.

In order to realize such printing, it suffices to prepare, with regard to black for example, eight mask patterns having a print permission rate of 12.5% for each group and being in complementary relation to each other. In addition, with regard to cyan, magenta, and yellow, it suffices to assign six mask patterns having a print permission rate of (100/6≈16.7)% and being in complementary relation to each other to the first to the sixth groups, and set the print permission rate of the seventh and the eighth groups to 0%.

In the present embodiment, as thus described, only black ink (K) which is an achromatic color is printed at least in the last print scan for a unit region. According to such a configuration, a layer of achromatic color ink is formed on the topmost layer in a unit region of the print medium.

Generally, since a color material of achromatic color ink includes components that cause bronze phenomenon less than chromatic color ink, applying achromatic color ink on the topmost layer can efficiently suppress bronze phenomenon in an image. At the same time, since an achromatic color does not have a particular hue unlike a chromatic color, hue of the original image will not be significantly changed by adding an achromatic color. Referring to FIG. 16 again, considering the characteristics of such an achromatic color ink, the color conversion process of the present embodiment (postprocess J0003) generates black data to a degree that does not affect chroma and brightness of an image. The printing apparatus 104 then performs printing operation according to the print permission rate as shown in FIG. 1. With such a configuration, it becomes possible to effectively suppress bronze phenomenon without causing hue shift in the input image data.

Although it is assumed in the description of FIG. 1 that the print permission rate of chromatic color ink of the seventh and the eighth groups is 0%, i.e., there is no print-permitted pixel of a chromatic color ink in the last print scan, the present embodiment is not limited to such a configuration. In the present invention and the embodiment, effect of the present embodiment can be obtained more or less, as long as the print permission rate of achromatic color ink is higher than the print permission rate of chromatic color ink at least in the last print scan of multipass printing. The following describes several examples in which the print permission rate of chromatic color ink in the last print scan is not set to be 0%.

Figure 8A:
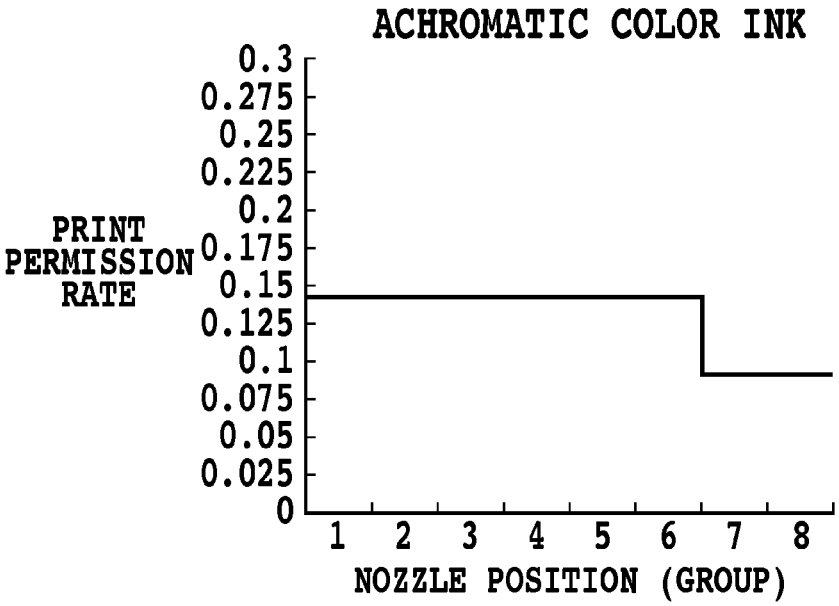
FIGS. 8A and 8B illustrate another exemplary first embodiment.
Figure 8B:
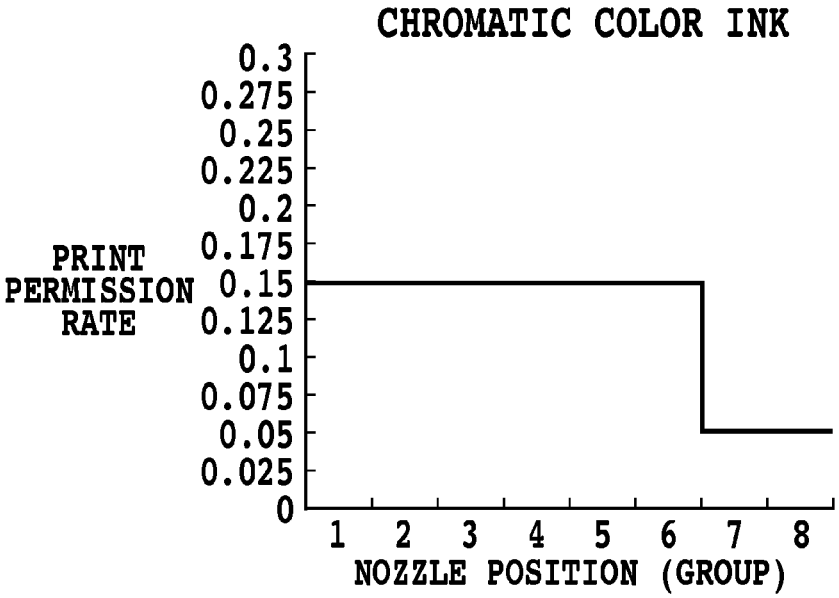

FIGS. 8A and 8B are explanatory diagrams of an example in which the print permission rate of chromatic color ink is not set to be 0% in the last print scan as described above. In both diagrams, the horizontal axis indicates a nozzle position or a nozzle group in the nozzle array, and the vertical axis indicates the print permission rate of individual nozzles or a nozzle group. In the case of this example, there is no group having a print permission rate of 0% in both achromatic color ink and chromatic color ink. However, in the first to the sixth groups, the print permission rate of chromatic color ink is set higher than that of achromatic color ink, whereas the print permission rate of achromatic color ink is set higher than that of chromatic color ink in the seventh and the eighth groups. Performing printing using a mask pattern according to such a print permission rate, at least in last print scan, the printing ratio of achromatic color ink may be higher than that of chromatic color ink. As a result, the ratio of applying achromatic color ink on the topmost layer becomes high, whereby it becomes possible to suppress bronze phenomenon.

Figure 9A:
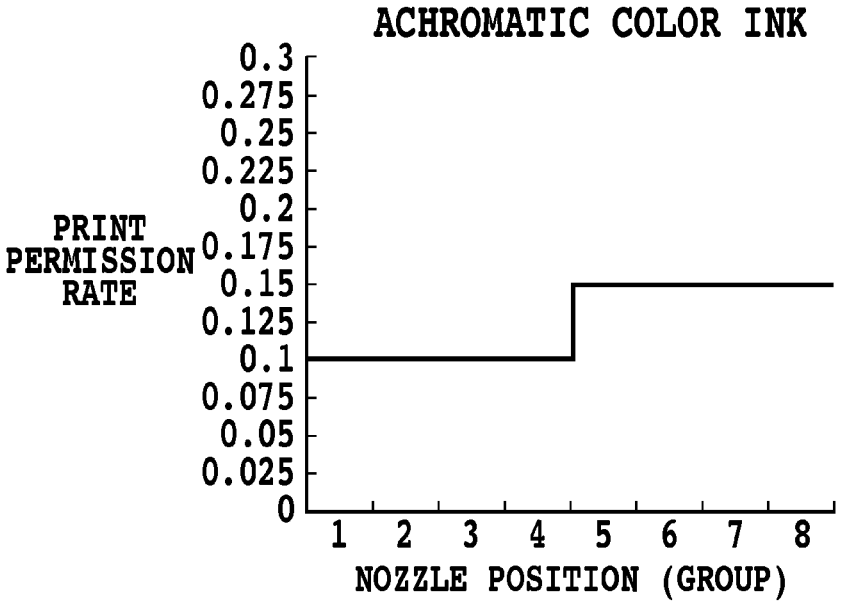
FIGS. 9A and 9B illustrate another exemplary first embodiment.
Figure 9B:
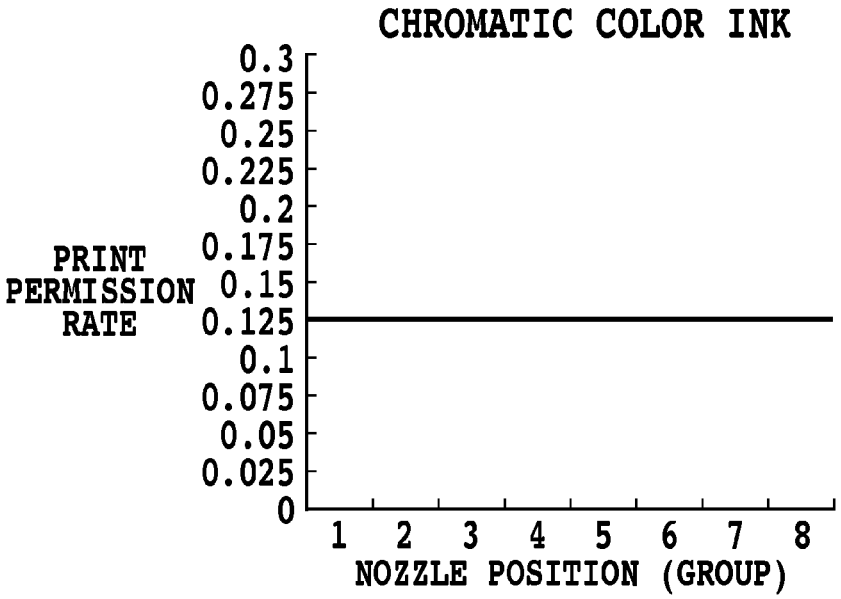

Furthermore, FIGS. 9A and 9B are explanatory diagrams of another example in which the print permission rate of chromatic color ink is not set to be 0% in the last print scan. In the case of this example, the print permission rate for chromatic color ink is uniformly 12.5% in the first to the eighth groups. With regard to this, although the print permission rate of achromatic color ink is lower than that of chromatic color ink in the first to the fourth groups, the print permission rate in the fifth to the eighth groups is set higher than that of chromatic color ink. If printing is performed using a mask pattern according to such a print permission rate, the print permission rate of achromatic color ink can be set higher than that of chromatic color ink in latter print scans including the last print scan. As a result, the ratio of applying achromatic color ink on the topmost layer becomes high, and whereby it becomes possible to effectively suppress bronze phenomenon.

In the foregoing, a configuration has been described in which the print permission rate of achromatic color ink is set higher than that of chromatic color ink in the eighth print scan which is the last print scan and the immediately precedent seventh print scan in 8-pass multipass printing. However, the effect of the present embodiment can be obtained as long as the print permission rate of achromatic color ink is higher than that of chromatic color ink at least in the last print scan. In this occasion, setting the print permission rate of achromatic color ink higher than that of chromatic color ink in a plurality of print scans including at least the last print scan as with the above example assures that the topmost layer is reliably formed with achromatic color ink, whereby bronze phenomenon can be effectively suppressed.

In particular, it is preferred to set the print permission rate of achromatic color ink higher than that of chromatic color ink in a plurality of print scans including at least the last print scan, when performing interlaced printing in which the print density along the Y-direction (direction of conveyance) is set higher than the arrangement density of the nozzles. The same goes for a case where one raster is printed by a plurality of print scans in order to set the print density of the X-direction (scan direction) higher than the print density by which the print head can print in one print scan.

Second Embodiment

In the present embodiment, a configuration will be described in which gray (Gy) ink having a lower coloring material concentration than black ink is prepared in addition to black (K) ink as achromatic color ink.

Figure 2:
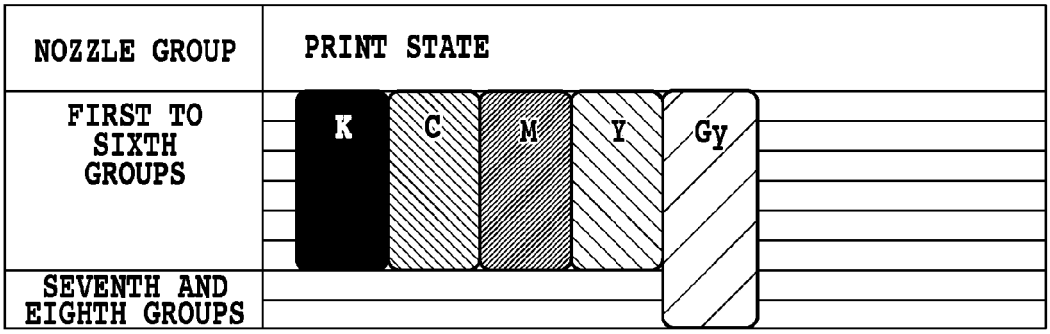
FIG. 2 is an explanatory diagram of a print state in a second embodiment.

FIG. 2 is an explanatory diagram similar to FIG. 1 of the print state of each group when performing multipass printing of the present embodiment. Similarly to the first embodiment, when performing 8-pass multipass printing, 256 nozzles are divided into 8 groups, each including 32 nozzles. In the present embodiment, although gray (Gy) ink is printed in all the first to the eighth groups, black (K), cyan (C), magenta (M), and yellow (Y) ink are not printed in the seventh and the eighth groups. As a result, only gray ink is printed over a unit region equivalent to the width of 32 nozzles in the seventh and the eighth print scans.

In order to realize such printing, it suffices to prepare, with regard to gray ink, eight mask patterns having a print permission rate of 12.5% for each group and being in complementary relation to each other, for example. In addition, with regard to cyan, magenta, and yellow, it suffices to assign six mask patterns having a print permission rate of (100/6≈16.7)% and being in complementary relation to each other to the first to the sixth groups, and set the print permission rate of the seventh and the eighth groups to 0%.

In the present embodiment, as thus described, only gray ink (Gy) is printed at least in the last print scan for a unit region. According to such a configuration, a layer of gray ink is formed on the topmost layer in a unit region of the print medium.

As has already been described, black ink can indeed efficiently suppress bronze phenomenon, without any significant hue shift of the original image by adding black ink.

However, since black ink basically has a high coloring material concentration, its affect on chroma and brightness of the image tends to be large. Therefore, generating black data to a degree that does not affect chroma and brightness of the image in the color conversion process (postprocess J0003) as in the first embodiment only results in a small signal value thereof, with a narrow color gamut that can exhibit the effect of reduced bronze. In addition, also in the color gamut that can exhibit the effect of reduced bronze, the amount allowed to apply black ink is small and may not be sufficient to form the topmost layer.

Gray ink, in contrast, has been produced so as to have a coloring material concentration lower than black ink. Therefore, a bronze phenomenon reduction effect and an effect that does not affect hue of the original image is equivalent to black ink. In addition, since gray ink has a lower coloring material concentration than black ink, it will not affect chroma and brightness of the image as much as black ink even if printing is performed with a same printing duty. In other words, using gray ink as achromatic color ink to be applied on the topmost layer, a larger amount can be applied than black ink without influencing chroma and brightness of the image, whereby bronze phenomenon reduction effect can be obtained more reliably.

Therefore, the present embodiment has employed a printing method that increases the ratio of gray ink on the topmost layer of an image as much as possible, using the characteristics of such gray ink more positively. Specifically, gray data is generated in the color conversion process (postprocess J0003) to a degree that does not affect chroma and brightness of an image. The printing apparatus 104 then performs printing operation according to the print permission rate shown in FIG. 2, for example. By such a configuration, it becomes possible to suppress bronze phenomenon more reliably without causing hue shift, and also without reducing chroma and brightness of the input image data input.

Figure 3:
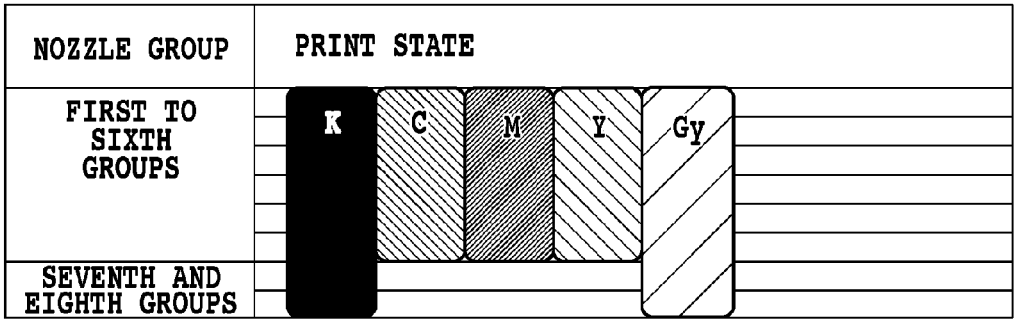
FIG. 3 is an explanatory diagram of another example of a print state in the second embodiment.

In this case, both black ink and gray ink may be used for printing in the seventh and the eighth groups, as shown in FIG. 3. With such a configuration, the effect of printing on the topmost layer using achromatic color ink can also be obtained, whereby it becomes possible to reliably suppress bronze phenomenon without reducing chroma and brightness. In the present embodiment, the effect is exerted if at least one type of achromatic color ink is printed with a higher print permission rate (more pixels) than chromatic color ink in the last print scan for a unit region.

In addition, it is also possible in the present embodiment, as with the first embodiment, to form the topmost layer with achromatic color ink by setting the print permission rate of achromatic color ink higher than that of chromatic color ink at least in the last print scan, whereby bronze phenomenon can be effectively suppressed. Therefore, a print permission rate such as those as shown in FIGS. 9 and 10 can be employed also in the present embodiment.

Third Embodiment

The present embodiment describes a form of using much more types of chromatic color ink in addition to the second embodiment. As chromatic color ink, there are, for example, light cyan ink (LC) and light magenta ink (LM) having a lower coloring material concentration than cyan and magenta inks. In addition, there are red ink (R), green ink (G), and blue ink (B) with different hue from cyan, magenta, and yellow inks. Japanese Patent Laid-Open No. 2008-162094 discloses a technique of expanding the color gamut that can be expressed by printing ink having a higher brightness later than ink having a lower brightness in such a configuration using many types of ink.

Figure 4:
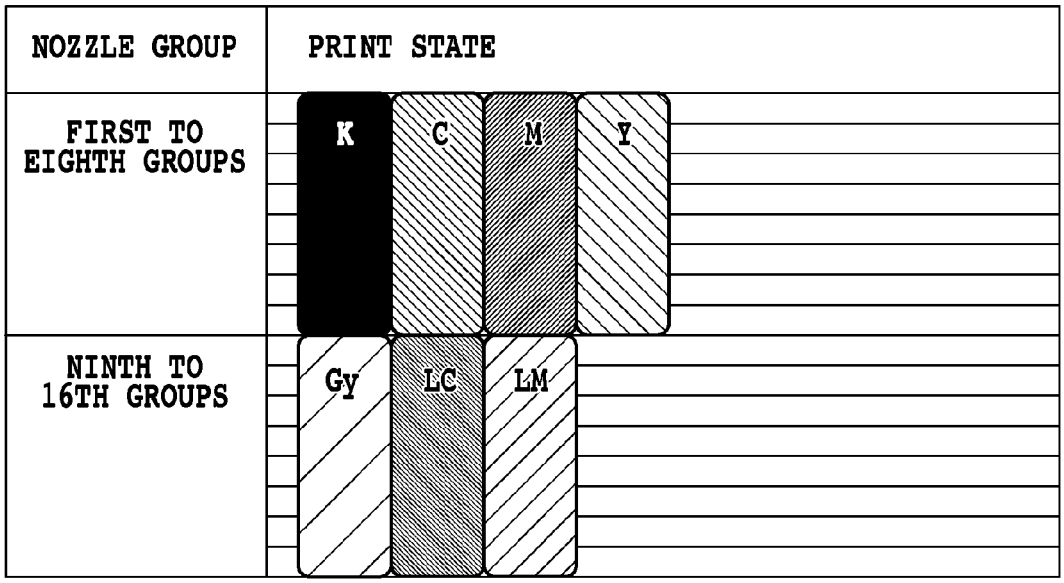
FIG. 4 illustrates a print state according to Japanese Patent Laid-Open No. 2008-162094.

FIG. 4 is an explanatory diagram of a printing method of printing, in the configuration added to the second embodiment, light cyan (LC) ink having a lower coloring material concentration than cyan ink and light magenta (LM) ink having a lower coloring material concentration than magenta ink in a case where the method of Japanese Patent Laid-Open No. 2008-162094 is employed. Here, a case of performing 16-pass multipass printing will be described as an example.

When performing 16-pass multipass printing, 256 nozzles are divided into 16 groups, each including 16 nozzles. FIG. 4 illustrates, for each ink color, groups actually used for printing out of the 16 groups. In this example, as can be seen from the drawing, black (K), cyan (C), magenta (M), and yellow (Y) ink are printed in the first to the eighth groups but are not printed in the 9th to the 16th groups. In addition, gray (Gy) light cyan (LC), and light magenta (LM) are not printed in the first to the eighth groups but are printed in the 9th to the 16th groups. As a result, after layers of black, cyan, magenta, and yellow ink having a relatively low brightness are formed over a unit region equivalent to the width of 16 nozzles, layers of gray (Gy), light cyan (LC), and light magenta (LM) having a relatively high brightness are formed thereon.

According to Japanese Patent Laid-Open No. 2008-162094, the color gamut of the image that can be expressed by the printing apparatus can be expanded by printing in the above order, in comparison with printing all the colors simultaneously.

Figure 5:
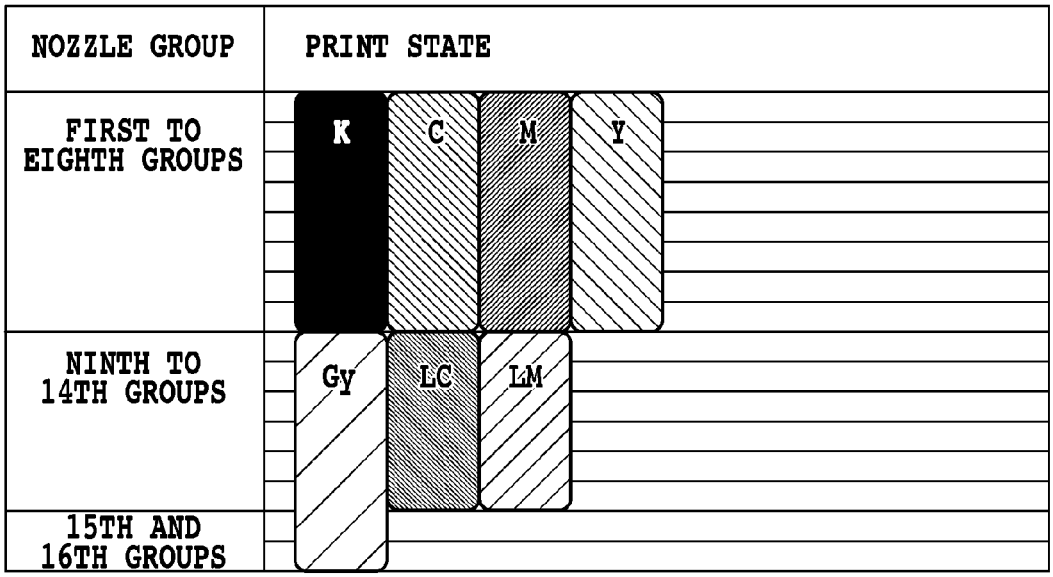
FIG. 5 is an explanatory diagram of a print state in a third embodiment.

On the other hand, FIG. 5 illustrates the print state when the printing method characteristic of the present invention is further employed in addition to the printing method of FIG. 4. The difference from the printing method of FIG. 4 lies in that light cyan (LC) ink and light magenta (LM) ink are not printed by the 15th and the 16th groups. With such a configuration, only gray ink which is achromatic color ink is printed the last two print scans for a unit region. In other words, according to the printing method of the present embodiment, gray ink which is achromatic color ink having a high brightness may forms the top layer, while forming a layer of ink having a high brightness on an upper layer than a layer of ink having a low brightness. As a result, an image realizing both a wide color gamut expression and the effect of reducing bronze phenomenon can be obtained.

Figure 6:
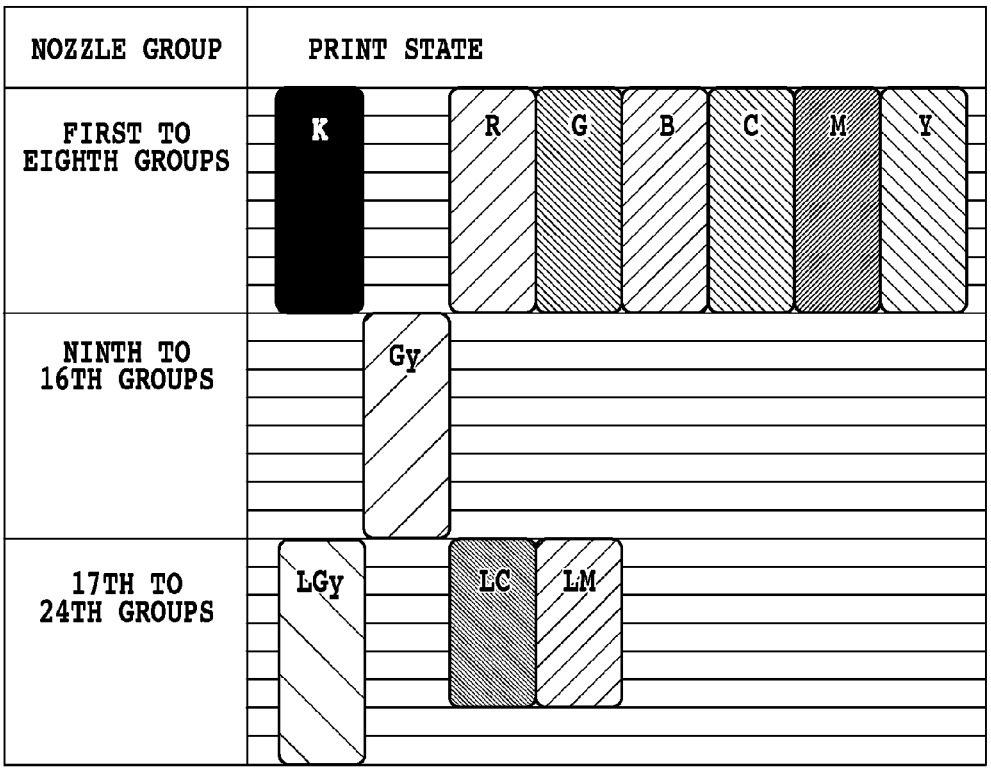
FIG. 6 is an explanatory diagram of another example of a print state in the third embodiment.

FIG. 6 is an explanatory diagram of a printing method for a case where red (R) ink, green (G) ink, blue (B) ink, and light gray (LGy) ink having a lower coloring material concentration than gray ink are prepared in addition to the configuration of FIG. 5. Here, a case of performing 24-pass multipass printing will be described as an example.

When perform 24-pass multipass printing, individual nozzle arrays are divided into 24 groups along the direction of conveyance. In FIG. 6, black (K), cyan (C), magenta (M), yellow (Y), red (R), green (G), and blue (B) inks are printed by the first to the eighth groups but are not printed by the ninth to the 24th groups. Gray (Gy) ink is printed by the 9th to the 16th groups but is not printed by the first to the eighth groups and the 17th to the 24th groups. Light cyan (LC) and light magenta (LM) inks are printed by the 17th to the 22nd-group but are not printed by the first to the 16th groups and the 23rd to the 24th groups. Furthermore, light gray (LGy) ink is printed in the 17th to the 24th groups but is not printed by the first to the 16th groups. As a result, after a layer of ink having a relatively low brightness is formed over a unit region, a layer of ink having a relatively high brightness is formed thereon, and a layer of light gray (LGy) which is achromatic color ink is further formed on the topmost layer. By printing in the above order, a much wider color gamut expression and a much more effective bronze phenomenon reduction can be expected in comparison with the case of FIG. 5.

Figure 7:
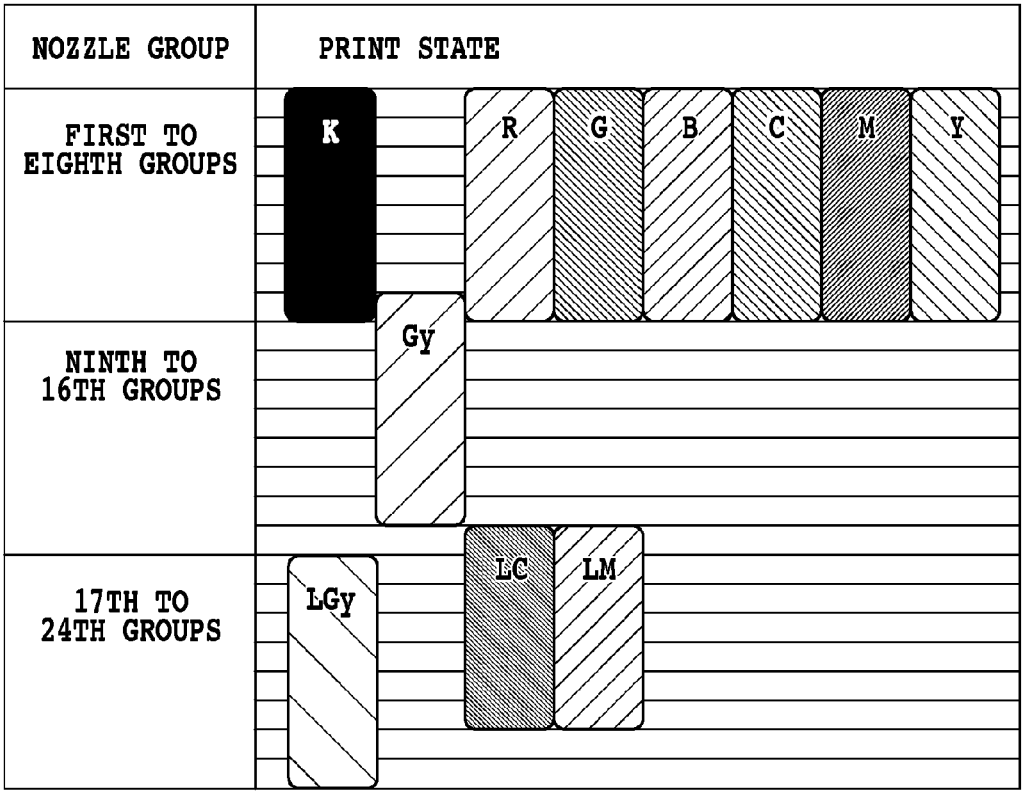
FIG. 7 is an explanatory diagram of another example of a print state in the third embodiment.

FIG. 7 is an explanatory diagram of another printing method using ink which is similar to FIG. 6. In FIG. 7, black (K), cyan (C), magenta (M), yellow (Y), red (R), green (G), and blue (B) inks are printed by the first to the eighth groups but are not printed by the ninth to the 24th groups. Gray (Gy) ink is printed by the eighth to the 15th groups, but the region of the eighth group overlaps with black and chromatic color ink having a low brightness, i.e., cyan (C), magenta (M), yellow (Y), red (R), green (G), and blue (B) inks. Light cyan (LC) ink and light magenta (LM) ink are printed by the 16th to the 22nd groups, and light gray (LGy) ink is further printed by the 17th to the 24th groups. With such a configuration, a layer of ink having a high brightness can be formed over a layer of ink having a low brightness, and the number of groups used for printing of light cyan ink and light magenta ink can be increased in comparison with the case of FIG. 6. In other words, since the number of multi-passes of light cyan ink and light magenta ink can be increased from 6 to 8 passes, it becomes possible to print images having enhanced uniformity.

The present embodiment is not limited to the above-mentioned printing form, as with the first embodiment. Setting the print permission rate of achromatic color ink (LGy) higher than chromatic color ink at least in the last print scan allows the topmost layer to be formed with achromatic color ink more reliably, whereby bronze phenomenon can be effectively suppressed.

Figure 10A:
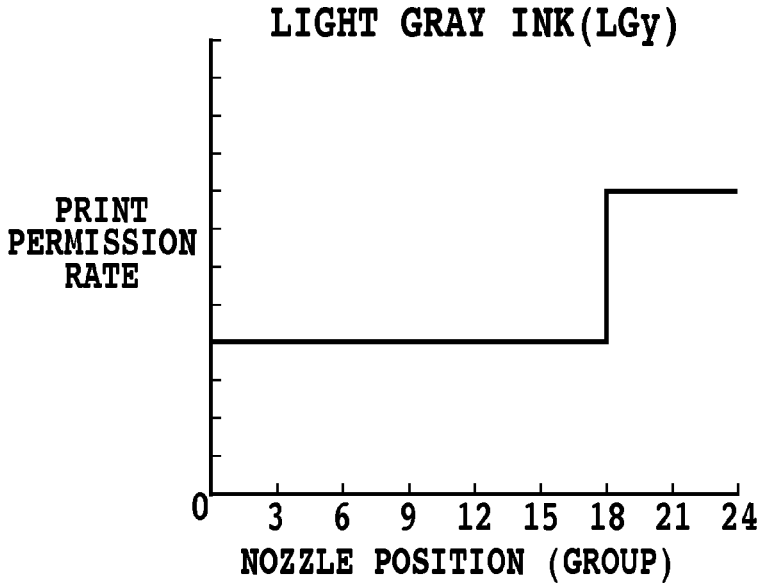
FIGS. 10A and 10B illustrate another exemplary third embodiment.
Figure 10B:
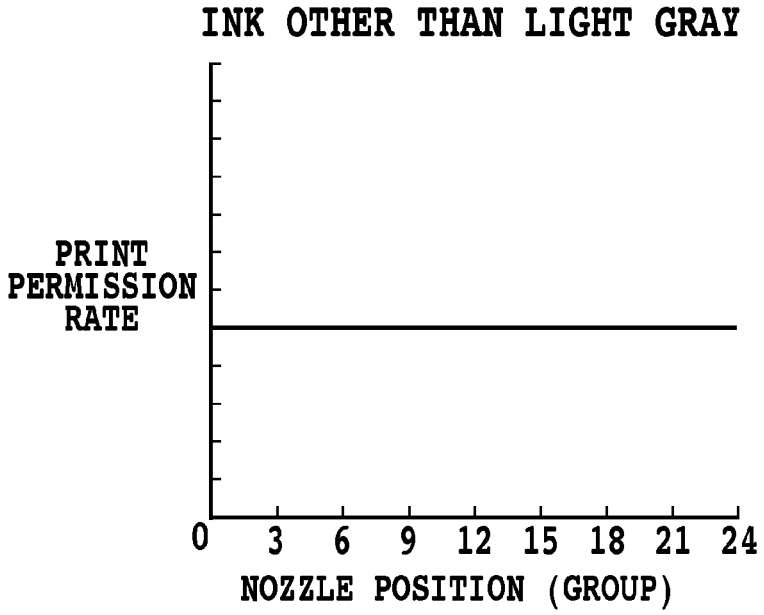

FIGS. 10A and 10B are explanatory diagrams, similar to FIGS. 9A and 9B, of an example in which the print permission rate of chromatic color ink is not set to be 0% in the last print scan. In the case of this example, there is no group with a print permission rate of 0% in both light gray and other ink. In the first to the 18th groups, however, the print permission rate of ink other than light gray ink is set higher than light gray ink, whereas the print permission rate of light gray ink is set higher than other ink in the 19th to the 24th groups. By using a mask pattern according to such a print permission rate to perform printing, the ratio of printing the light gray ink which is achromatic color ink can be increased at least in the last print scan. As a result, the ratio of applying achromatic color ink on the topmost layer becomes high, whereby it becomes possible to suppress bronze phenomenon.

Figure 11A:
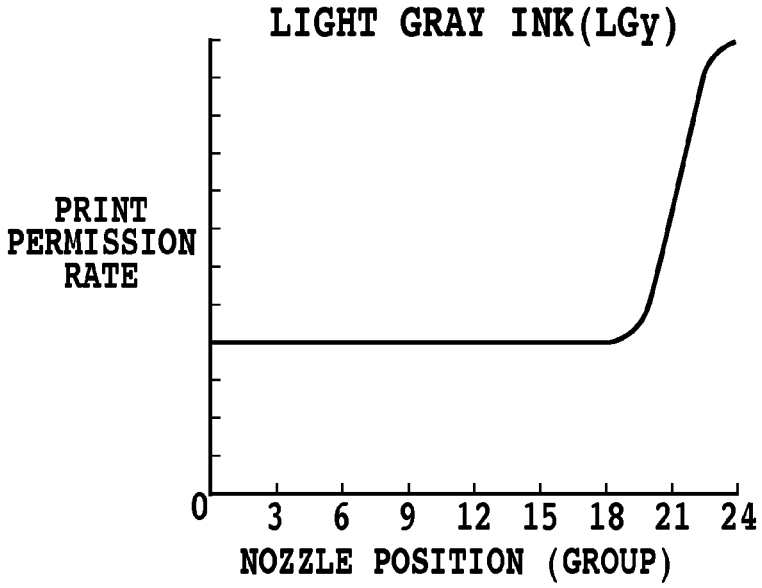
FIGS. 11A and 11B illustrate another exemplary third embodiment.
Figure 11B:
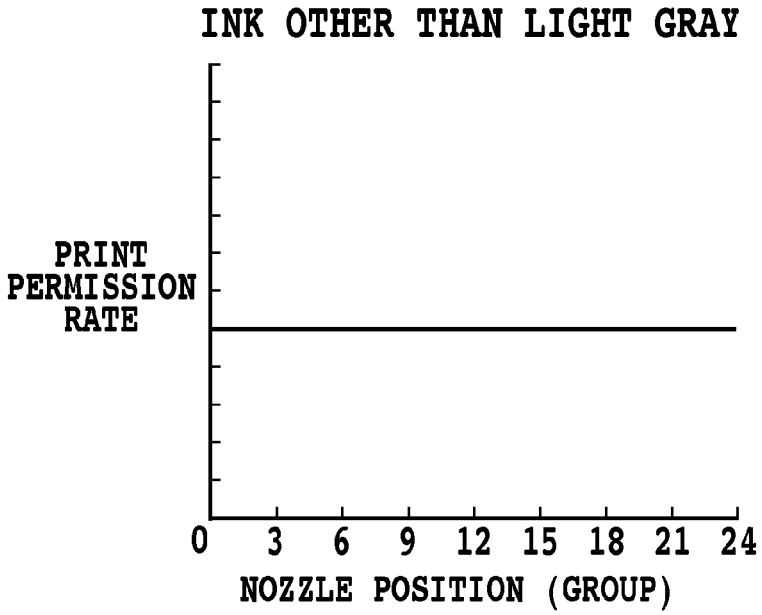

Furthermore, FIGS. 11A and 11B are explanatory diagrams of another example which increases the print permission rate of light gray ink in the vicinity of the last print scan. In the case of this example, the print permission rate is uniform in all the groups for ink other than light gray ink. In contrast, although the print permission rate of light gray ink is lower than other ink in the first to the 18th groups, the print permission rate is continuously increased in the 19th group and later. Also in the case of using a mask pattern according to such a print permission rate to perform printing, the print permission rate of light gray ink which is achromatic color ink can be set higher than other ink in latter print scans including the last print scan. As a result, the ratio of applying achromatic color ink on the topmost layer becomes high, whereby it becomes possible to effectively suppress bronze phenomenon.

Figure 12A:
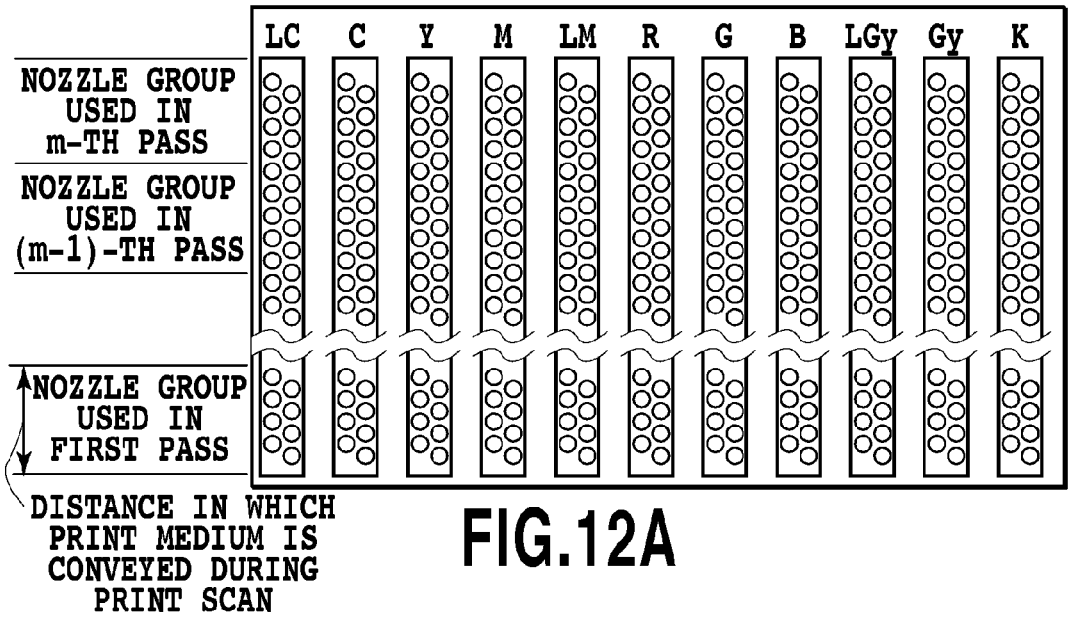
FIGS. 12A and 12B illustrate a print head applicable to the third embodiment.
Figure 12B:
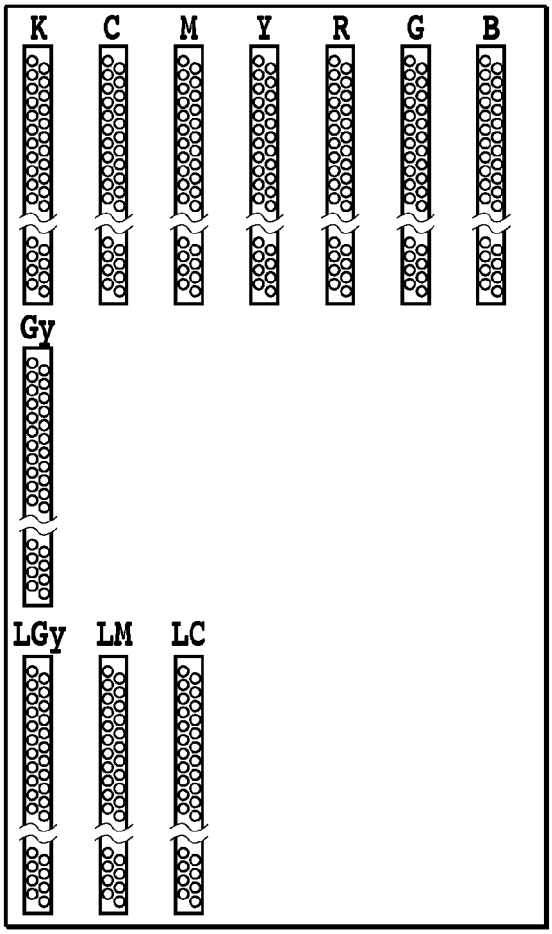

In the foregoing, description has been provided based on a case of using print head configured so that nozzle arrays of all the ink colors have a same number of nozzles along the sub-scanning direction, as with FIG. 12A. In the present embodiment, however, it is also effective to prepare a print head having nozzle arrays of respective colors arranged in a manner displaced from each other along the sub-scanning direction as shown in FIG. 12B, in order to realize the print state such as that of FIG. 6, for example. In this manner, an image realizing both a wide color gamut expression and the effect of reducing bronze phenomenon can be obtained, while effectively using all the nozzles arranged in a nozzle array.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-072218, filed Mar. 29, 2011, which is hereby incorporated by reference herein in its entirety.

What is claimed is:

1. A printing system for printing an image on a unit region of a print medium according to image data by effecting plural print scans of plural nozzle arrays configured to respectively eject chromatic color inks and nozzle arrays configured to respectively eject achromatic color inks including a first achromatic color ink that is black ink and a second achromatic color ink which has a lower coloring material concentration than the first achromatic color ink on the unit region, the plural nozzle arrays for the chromatic and achromatic color inks being arranged in a print scan direction without being shifted from one another in a direction crossing the print scan direction, the printing system comprising:

a color conversion unit configured to convert the image data into a plurality of color signals corresponding to the first achromatic color ink, the second achromatic color ink and the chromatic color inks, respectively; and a defining unit for defining pixels permitted to print and pixels not permitted to print for each of the print scans and for each of the plural nozzle arrays for the chromatic and achromatic color inks according to the plurality of color signals, wherein, in a case where the input image data represents a chromatic color, the color conversion unit converts the input image data into the plurality of color signals such that an amount of the second achromatic color ink applied to the unit region is greater than an amount of the first achromatic color ink applied to the unit region, and the defining unit defines such that there are more pixels permitted to print for the second achromatic color ink than pixels permitted to print for any of the first achromatic color ink and the chromatic color inks on the unit region, in the last print scan among the plural print scans.

2. The printing system according to claim 1, wherein there is no pixel permitted to print for the chromatic color inks on the unit region in the last print scan among the plural print scans.

3. The printing system according to claim 1, wherein the achromatic color inks further include a third achromatic color ink having a lower coloring material concentration than the second achromatic color ink, and there are more pixels permitted to print for the third achromatic color ink than pixels permitted to print for any of the chromatic color inks on the unit region in the last print scan among the plural print scans.

4. The printing system according to claim 1, wherein the chromatic color inks include cyan, magenta and, yellow inks.

5. The printing system according to claim 1, wherein the chromatic color inks include cyan ink, light cyan ink having a lower coloring material concentration than the cyan ink, magenta ink, light magenta ink having a lower coloring material concentration than the magenta ink, and yellow ink, the light cyan ink and light magenta ink are printed on the unit region in a print scan later than that for the cyan ink, magenta ink, and yellow ink, and there are more pixels permitted to print for the second achromatic color ink than pixels permitted to print for the light cyan ink and light magenta ink on the unit region in the last print scan among the plural print scans.

6. The printing system according to claim 1, wherein the chromatic color inks include cyan ink, light cyan ink having a lower coloring material concentration than the cyan ink, magenta ink, light magenta ink having a lower coloring material concentration than the magenta ink, yellow ink, red ink, green ink, and blue ink, the achromatic color inks further include a third achromatic color ink having a lower coloring material concentration than the second achromatic color ink, the light cyan ink and light magenta ink are printed on the unit region in a print scan later than that for the cyan ink, magenta ink, yellow ink, red ink, green ink, and blue ink, and there are more pixels permitted to print for the third achromatic color ink than pixels permitted to print for the light cyan ink and light magenta ink on the unit region in the last print scan among the plural print scans.

7. The printing system according to claim 1, wherein there is no pixel permitted to print for any of the chromatic color inks or the first achromatic color ink on the unit region in the last print scan.

8. An inkjet printing method which prints an image on a unit region of a print medium according to image data by effecting plural print scans of plural nozzle arrays configured to respectively eject chromatic color inks and a nozzle array configured to respectively eject achromatic color inks including a first achromatic color ink that is black ink and a second achromatic color ink which has a lower coloring material concentration than the first achromatic color ink on the unit region, the plural nozzle arrays for the chromatic and achromatic color inks being arranged in a print scan direction without being shifted from one another in a direction crossing the print scan direction, the method comprising:

a color conversion step for converting the image data into a plurality of color signals corresponding to the first achromatic color ink, the second achromatic color ink and the chromatic color inks, respectively; and a defining step for defining pixels permitted to print and pixels not permitted to print for each of the print scans and for each of the plural nozzle arrays for the chromatic and achromatic color inks according to the plurality of color signals, wherein, in a case where the input image data represents a chromatic color, the color conversion step converts the input image data into the plurality of color signals such that an amount of the second achromatic color ink applied to the unit region is greater than an amount of the first achromatic color ink applied to the unit region, and the defining step defines such that there are more pixels permitted to print for the second achromatic color ink than pixels permitted to print for any of the first achromatic color ink and the chromatic color inks on the unit region, in the last print scan among the plural print scans.

9. The inkjet printing method according to claim 8, wherein the achromatic color inks further include a third achromatic color ink having a lower coloring material concentration than the second achromatic color ink, and there are more pixels permitted to print by the third achromatic color ink than pixels permitted to print by any of the chromatic color inks on the unit region in the last print scan among the plural print scans.

10. The inkjet printing method according to claim 8, wherein there is no pixel permitted to print for any of the chromatic color inks or the first achromatic color ink on the unit region in the last print scan.

* * * * *